US009601854B2

(12) United States Patent
Kutsuna et al.

(10) Patent No.: US 9,601,854 B2
(45) Date of Patent: Mar. 21, 2017

(54) FEMALE TERMINAL

(71) Applicant: YAZAKI CORPORATION, Tokyo (JP)

(72) Inventors: Yoji Kutsuna, Shizuoka (JP); Shin Nemoto, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/441,371

(22) PCT Filed: Dec. 2, 2013

(86) PCT No.: PCT/JP2013/082398
§ 371 (c)(1),
(2) Date: May 7, 2015

(87) PCT Pub. No.: WO2014/087977
PCT Pub. Date: Jun. 12, 2014

(65) Prior Publication Data

US 2015/0280341 A1 Oct. 1, 2015

(30) Foreign Application Priority Data

Dec. 4, 2012 (JP) ..... 2012-265394

(51) Int. Cl.
*H01R 13/11* (2006.01)
*H01R 43/16* (2006.01)
*H01R 4/18* (2006.01)

(52) U.S. Cl.
CPC ..... *H01R 13/11* (2013.01); *H01R 13/113* (2013.01); *H01R 43/16* (2013.01); *H01R 4/185* (2013.01)

(58) Field of Classification Search
CPC ..... H01R 13/11; H01R 13/113; H01R 13/114; H01R 13/115; H01R 31/06; H01R 24/68; H01R 43/26; H01R 24/64
(Continued)

(56) References Cited

U.S. PATENT DOCUMENTS 5,897,405 A * 4/1999 Endo ..... H01R 13/11 439/852
6,736,684 B2 * 5/2004 Ishiyama ..... H01R 13/187 439/852
(Continued)

FOREIGN PATENT DOCUMENTS

CN 1653650 A 8/2005
CN 1976127 A 6/2007
(Continued)

OTHER PUBLICATIONS

International Search Report and Written Opinion of the International Search Report for PCT/JP2013/082398 dated Jan. 14, 2014.
(Continued)

*Primary Examiner* — Abdullah Riyami
*Assistant Examiner* — Harshad Patel
(74) *Attorney, Agent, or Firm* — Kenealy Vaidya LLP

(57) ABSTRACT

A terminal contact portion (15) of a female terminal (11) includes: a bottom plate (35); a first side plate (37) and a second side plate (41); a top plate (39) continuously bent from the first side plate (37); an elastic piece (19) bent to be overlaid on the top plate (39) at an elastic piece bent portion (47) corresponding to an end portion of the top plate (39) along a terminal lengthwise direction; a pair of engaging projections (43) provided to project in a bent edge portion of the elastic piece (19); and a pair of engaging holes (45) formed in the first side plate (37) correspondingly to the engaging projections (43).

13 Claims, 6 Drawing Sheets

(58) Field of Classification Search
USPC ..... 439/852, 853, 854, 855, 856, 857, 858, 439/845, 851, 595, 748, 816, 850, 859, 439/872
See application file for complete search history.

(56) References Cited

U.S. PATENT DOCUMENTS

| | | | | |
|---|---|---|---|---|
| 6,971,927 | B2 * | 12/2005 | Anbo | H01R 13/113 439/852 |
| 7,144,281 | B2 * | 12/2006 | Maeda | H01R 43/16 439/595 |
| 2001/0002350 | A1 * | 5/2001 | Kashiyama | H01R 13/11 439/848 |
| 2003/0220015 | A1 | 11/2003 | Ishiyama | |
| 2006/0172615 | A1 | 8/2006 | Noro et al. | |
| 2007/0111599 | A1 | 5/2007 | Tanaka | |
| 2007/0111614 | A1 | 5/2007 | Tanaka | |

FOREIGN PATENT DOCUMENTS

| | | | |
|---|---|---|---|
| JP | 2003-346957 | A | 12/2003 |
| JP | 2004-220825 | A | 8/2004 |
| JP | 2005-243437 | A | 9/2005 |
| JP | 2006-216316 | A | 8/2006 |
| JP | 2007-66525 | A | 3/2007 |
| JP | 2008-123740 | A | 5/2008 |
| JP | 2011-154944 | A | 8/2011 |

OTHER PUBLICATIONS

English language Written Opinion of the International Search Report for PCT/JP2013/082398 dated Jan. 14, 2014.

Korean Office Action for the related Korean Patent Application No. 10-2015-7014589 dated Sep. 27, 2016 (with English translation).

Chinese Office Action for the related Chinese Patent Application No. 201380063883.4 dated Jul. 13, 2016.

Japanese Office Action for the related Japanese Patent Application No. 2012-265394 dated Jul. 5, 2016.

Decision of Refusal for the related Japanese Patent Application No. 2012-265394 dated Jan. 17, 2017.

* cited by examiner

FEMALE TERMINAL

TECHNICAL FIELD

The present invention relates to a female terminal.

BACKGROUND ART

A female terminal attached to a connector for use in connecting an electric circuit is produced by forming a tubular terminal contact portion serving as a male terminal receiving portion by punching a metal plate of copper, brass or the like and bending the punched metal plate, and a spring piece is provided within the terminal contact portion for receiving a male terminal to be connected (see PTL 1).

In a female terminal 501, as illustrated in FIG. 6A, a tubular male terminal connection portion (a terminal contact portion) 503 includes a bottom plate 505, a spring piece 509 obtained by bending a portion on one side of the bottom plate 505 at a bent portion 507 disposed at one end thereof to be overlaid on the bottom plate 505, a first side plate 511 continuously bent on the other side of the bottom plate 505, a top plate 513 bent continuously to the first side plate 511, and a second side plate 515 bent continuously to the top plate 513. A positioning rib 517 is provided on the base of the spring piece 509, and a notch 519 to be engaged with the positioning rib 517 is formed in the first side plate 511.

In this female terminal 501, the positioning rib 517 provided on the base of the spring piece 509 is engaged with the notch 519 formed in the first side plate 511 for adjusting the position of the spring piece 509, and therefore, even if the position, the inclination and the elastic urging force of the spring piece 509 are shifted from those set up because of distortion or the like of the spring piece 509 caused when, for example, a male terminal receiving portion 521 is formed by bending, the spring piece 509 can be corrected to a properly assembled state.

CITATION LIST

Patent Literature

PTL 1: JP-A-2008-123740

SUMMARY OF INVENTION

Technical Problem

In the conventional female terminal 501 described above, however, since the positioning rib 517 is provided to project on the base of the spring piece 509 (namely, on a base side along a terminal lengthwise direction L of a bent side edge portion 523 of the spring piece 509 corresponding to an edge along a terminal widthwise direction W), the tip of the spring piece 509 is a free end whose position is not regulated. Therefore, in stamping the female terminal 501 including the spring piece 509 formed to be bent within the male terminal connection portion, the tip side of the spring piece 509 too uncontrollably moves in various directions (see arrowed directions illustrated in FIG. 6B) to be positioned in the male terminal connection portion, and it is difficult to surely obtain a stable contact load.

The present invention was accomplished in consideration of the aforementioned situation, and an object of the present invention is to provide a female terminal in which uncontrollable movement of an elastic piece within a terminal contact portion can be prevented to surely obtain a stable contact load.

Solution to Problem

The above-described object of the present invention is attained by the following constitution:

(1) A female terminal includes a tubular terminal contact portion for receiving a male terminal including a bottom plate, a first side plate and a second side plate that respectively rise from both ends of the bottom plate in a terminal widthwise direction, a top plate that is bend and continuous from the first side plate, an elastic piece in which an end portion of the top plate in a terminal lengthwise direction as an elastic piece bent portion is bent to be overlaid on the top plate, a pair of engaging projections that is provided to project at both end sides of the elastic piece in the terminal lengthwise direction at a bent edge portion of the elastic piece in the terminal widthwise direction, and a pair of engaging holes that is formed in the first side plate correspondingly to the pair of engaging projections. The engaging projections are respectively engaged with the engaging holes.

According to the female terminal having the constitution described in (1) above, if a force in a direction moving away from the top plate is applied to the elastic piece and the elastic piece is to move away from the top plate by a prescribed or larger distance, this movement of the elastic piece is restricted because the engaging projections provided to project on the bent edge portion hit against the engaging holes. Thus, the position of the elastic piece is restricted by the pair of engaging projections provided at the both ends (on the tip side and the base side) along the terminal lengthwise direction, and is prevented from making an excessive displacement (uncontrollable movement) with which a normal contact load cannot be obtained. As a result, the elastic piece is definitely positioned in a normal place to prevent the uncontrollable movement, and hence, a stable contact load can be surely obtained.

(2) The female terminal according to (1), a clearance smaller than an insertion length of the engaging projections inserted into the engaging holes is provided at least between the second side plate and the elastic piece.

According to the female terminal having the constitution described in (2) above, since the clearance is provided between the elastic piece and the second side plate, the elastic piece can be smoothly displaced without interfering with the second side plate when the elastic piece is moved due to the insertion of a male terminal. Therefore, insertion resistance of the male terminal can be prevented from increasing through, for example, sliding contact of the elastic piece with the second side plate. Furthermore, in the bending process of the female terminal or in inserting a male terminal, if the elastic piece is to be displaced in a direction for removing the engaging projections from the engaging holes, since the clearance provided between the second side plate and the elastic piece is smaller than the insertion length of the engaging projections inserted into the engaging holes, the elastic piece hits against the second side plate, and hence the engaging projections can be prevented from coming off from the engaging holes, and thus, reliability in obtaining a stable contact load can be improved.

The present invention has been simply described so far. The details of the present invention will be more clearly understood by reading the following description of a mode for practicing the present invention (hereinafter referred to as the "embodiment") with reference to the accompanying drawings.

DESCRIPTION OF EMBODIMENTS

An embodiment of the present invention will now be described with reference to the accompanying drawings.

Figure 1:
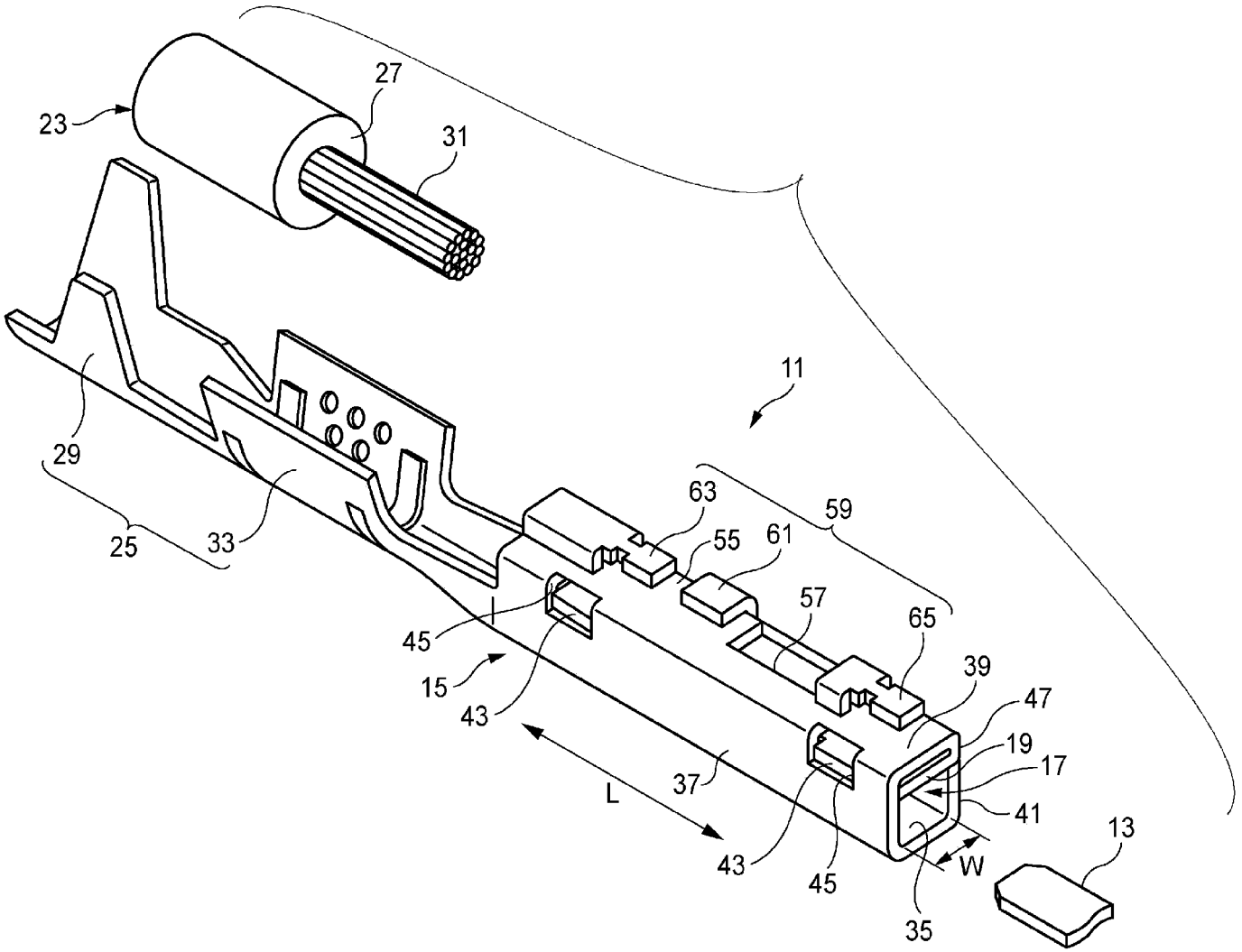
FIG. 1 is a perspective view of a female terminal according to one embodiment of the present invention.

As illustrated in FIG. 1, a female terminal 11 according to one embodiment of the present invention includes a terminal contact portion 15 to be brought into contact with a male terminal 13 to be connected. The inside of the terminal contact portion 15 corresponds to a male terminal receiving portion 17 for receiving the male terminal 13. Within the male terminal receiving portion 17, an elastic piece 19 to be elastically brought into contact with the male terminal 13 for obtaining an electrically connected state is contained (see FIGS. 2 and 3). The elastic piece 19 is supported in a cantilever manner to exhibit an elastic urging force, and has a free end formed in a reverse U-shape to work as a contact portion with the male terminal 13.

The male terminal 13 is inserted, from the right-hand side in FIG. 1, into the male terminal receiving portion 17 against the elastic urging force of the elastic piece 19 so as to be elastically brought into contact with the elastic piece 19 for obtaining electrical connection. The female terminal 11 is formed into a prescribed shape by stamping a metal plate 21 illustrated in FIG. 2, and includes a wire connection portion 25 connected to a wire 23. The wire connection portion 25 includes a sheath caulking portion 29 for holding the wire 23 from above a sheath 27 thereof, and a conductor caulking portion 33 for connecting, in a crimping manner, a conductor 31 of the wire 23.

Figure 2:
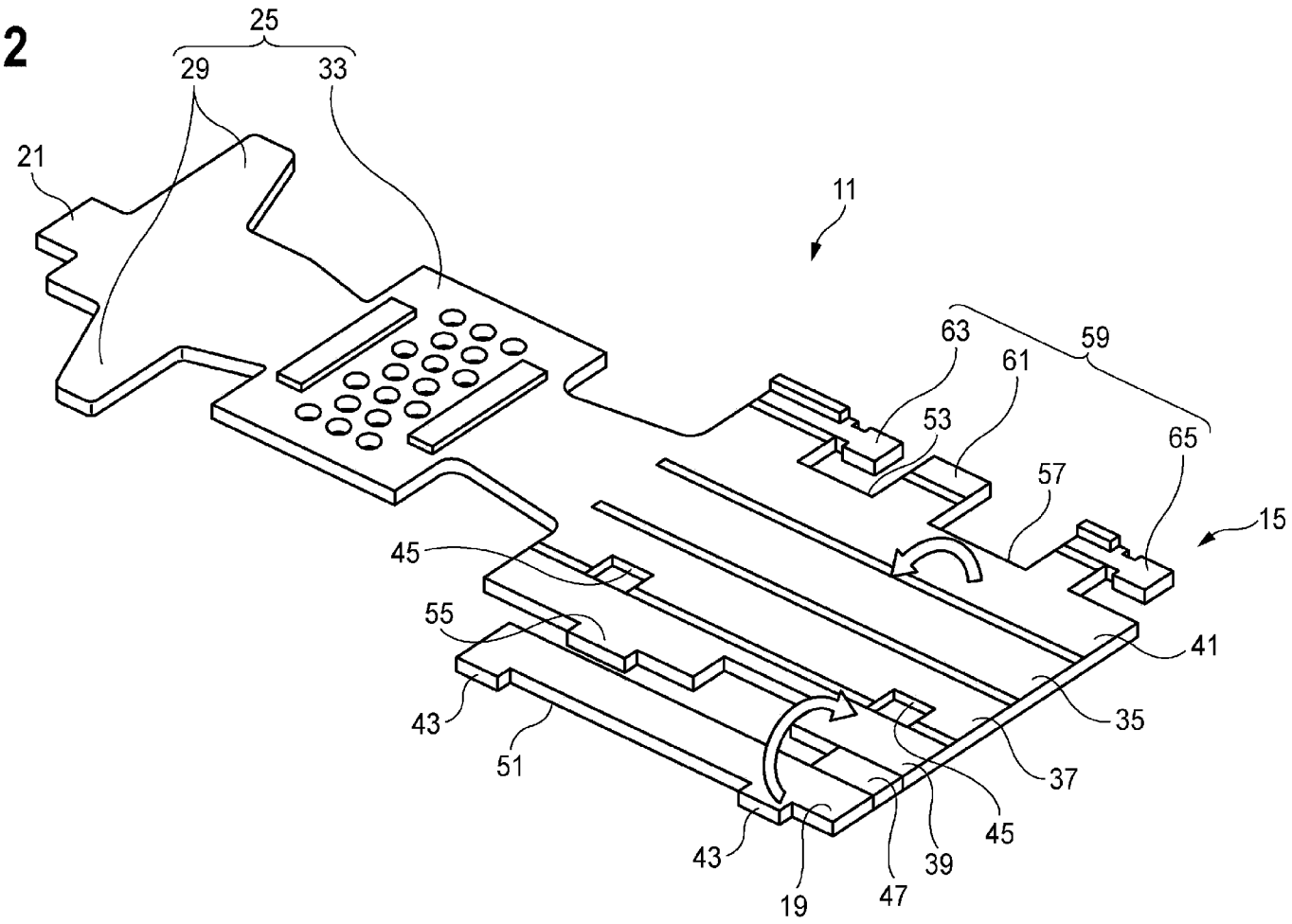
FIG. 2 is a developed view of a metal plate used for forming the female terminal of FIG. 1.

The terminal contact portion 15 of the female terminal 11 is formed in a tubular shape capable of receiving the male terminal 13. This terminal contact portion 15 includes, as illustrated in FIG. 2, a bottom plate 35, a first side plate 37, a top plate 39, a second side plate 41, the elastic piece 19, a pair of engaging projections 43, and a pair of engaging holes 45. The first side plate 37 and the second side plate 41 are caused to rise respectively from both ends along a terminal width direction of the bottom plate 35. The top plate 39 is bent continuously from the first side plate 37.

The elastic piece 19 is connected to the top plate 39 via an elastic piece bent portion 47 corresponding to an end portion of the top plate 39 along a terminal lengthwise direction (on a side of the terminal contact portion 15 for receiving the male terminal), and is bent to be overlaid on the top plate 39 with this elastic piece bent portion 47 disposed therebetween. In order to attain a good contact property, the elastic piece 19 is bent to have such a reverse U-shape that a substantially center portion thereof comes closer to the male terminal 13. In the present embodiment, the apex of the reverse U-shape is provided with an indent portion 49 bulged out toward the male terminal 13 for increasing the electrical contact property (see FIG. 3). The pair of engaging projections 43 are provided to project at both ends (on the tip side and the base side) along the terminal lengthwise direction L (see FIG. 1) of a bent edge portion 51 (see FIG. 2) corresponding to an edge of the elastic piece 19 along the terminal width direction W (see FIG. 1). The engaging holes 45 are formed in the first side plate 37 correspondingly to the engaging projections 43. The engaging projections 43 are respectively inserted into these engaging holes 45 to be engaged with them.

Figure 4A:
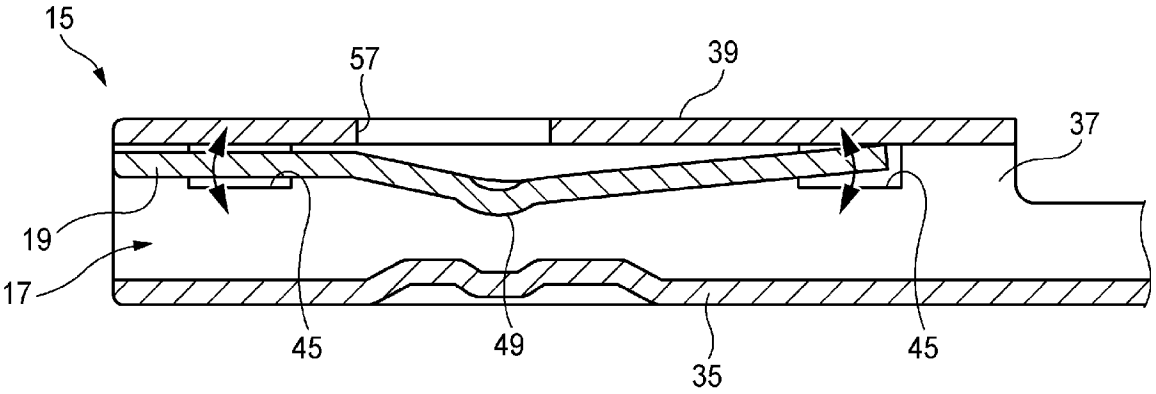
FIG. 4A is a side view of FIG. 3.
Figure 4B:
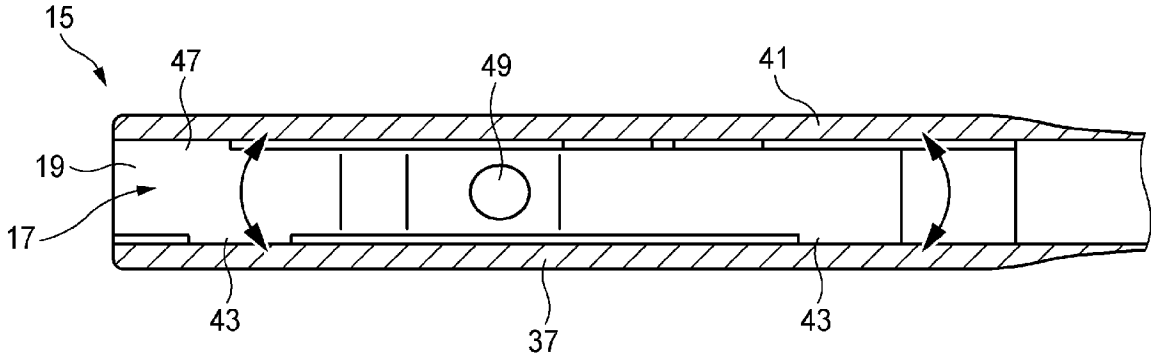
FIG. 4B is a bottom view of an elastic piece seen from a bottom plate side with the terminal contact portion of FIG. 1 partially cutaway.

In other words, when the engaging projections 43 are engaged with the engaging holes 45, excessive displacement (uncontrollable movement) of the elastic piece 19 in arrowed directions illustrated in FIGS. 4A and 4B is regulated during the production or in inserting/removing the male terminal 13.

Figure 5:
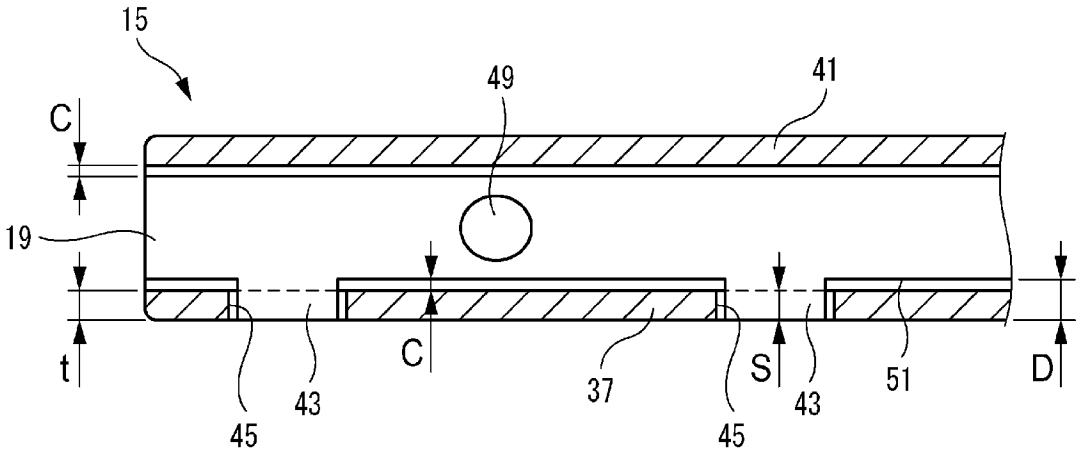
FIG. 5 is a plan view of the terminal contact portion of FIG. 4B cutaway in a position of an engaging hole of a first side plate.
Figure 6A:
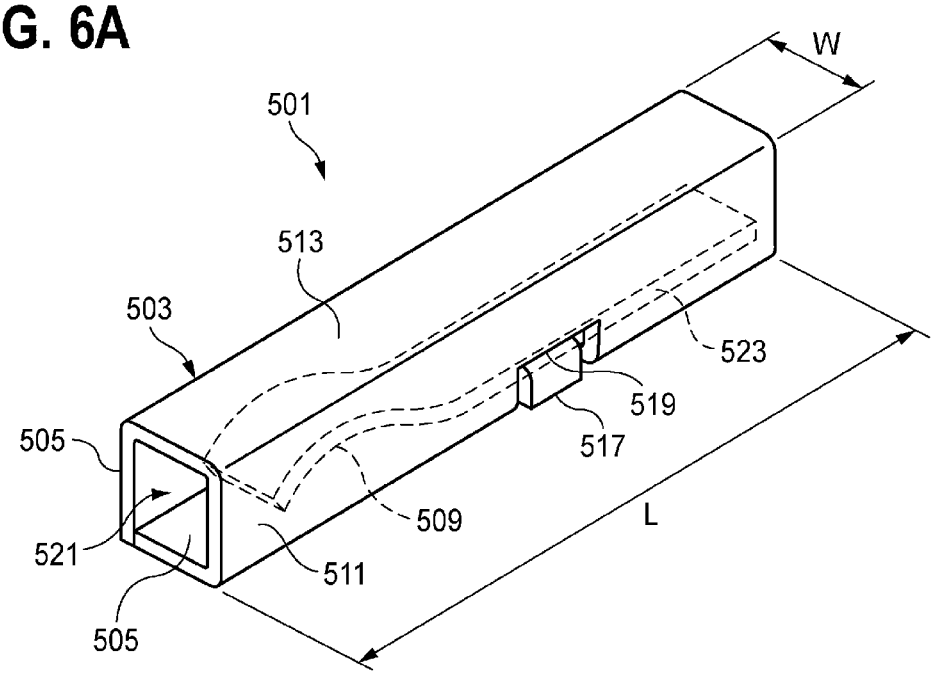
FIG. 6A is a perspective view of a conventional female terminal.
Figure 6B:
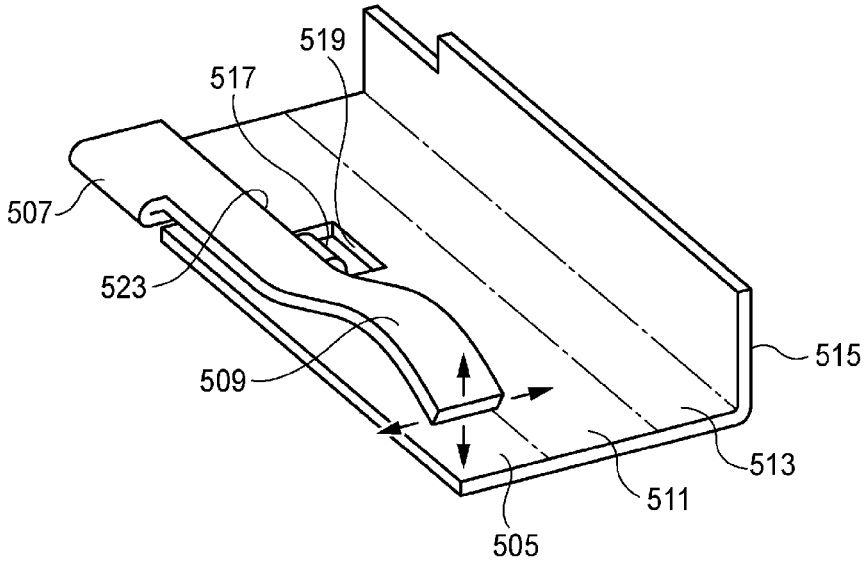
FIG. 6B is a diagram of a process for forming the conventional female terminal.

In the female terminal 11, a clearance C is provided between the elastic piece 19 and the second side plate 41 as illustrated in FIG. 5. This clearance C is preferably formed also between the elastic piece 19 and the first side plate 37. The clearance C is set to be smaller than an insertion length S of the engaging projections 43 inserted into the engaging holes 45. Specifically, if the metal plate 21 has a thickness t of 0.15 mm, the clearances C provided respectively from the first side plate 37 and the second side plate 41 are set to approximately 0.05 mm. Accordingly, a distance D from the bent edge portion 51 to the outer surface of the terminal contact portion 15 is 0.2 mm.

Besides, a projection piece 55 to be engaged with a notch 53 of the second side plate 41 and a lance engaging recess 57 to be engaged with a lance for retaining the female terminal provided in a terminal chamber of a connector housing not shown are formed in the top plate 39. Furthermore, a shape holding portion 59 is provided in the second side plate 41. The shape holding portion 59 is composed of a fixing piece portion 61 to be bent over the top plate 39 to be overlaid on the top plate 39, a rear pressing piece portion 63 and a front pressing piece portion 65.

Next, a method for producing the female terminal 11 having the aforementioned constitution will be described.

The female terminal 11 of the present embodiment is formed by bending one metal plate 21 having conductivity. First, the conductive metal plate 21 is punched into the prescribed shape illustrated in FIG. 2 so as to attain the shape of the female terminal 11 of FIG. 1 when assembled. The metal plate 21 is developed continuously as the elastic piece 19, the top plate 39, the first side plate 37, the bottom plate 35, the second side plate 41 and the shape holding portion 59, and boundaries between these respective sections correspond to bent portions.

The elastic piece 19 is formed continuously from the end (on the side of the terminal contact portion 15 for receiving a male terminal) of the top plate 39 via the elastic piece bent portion 47. In the top plate 39, the first side plate 37 is continuously formed on the opposite side to the elastic piece 19. The bottom plate 35 is continuously formed from the first side plate 37 on the opposite side to the top plate 39, and the second side plate 41 and the shape holding portion 59 are successively continuously formed from the bottom plate 35 on the opposite side to the first side plate 37. The elastic piece 19 is provided with the pair of engaging projections 43, and the engaging holes 45 are formed in the first side plate 37.

Figure 3:
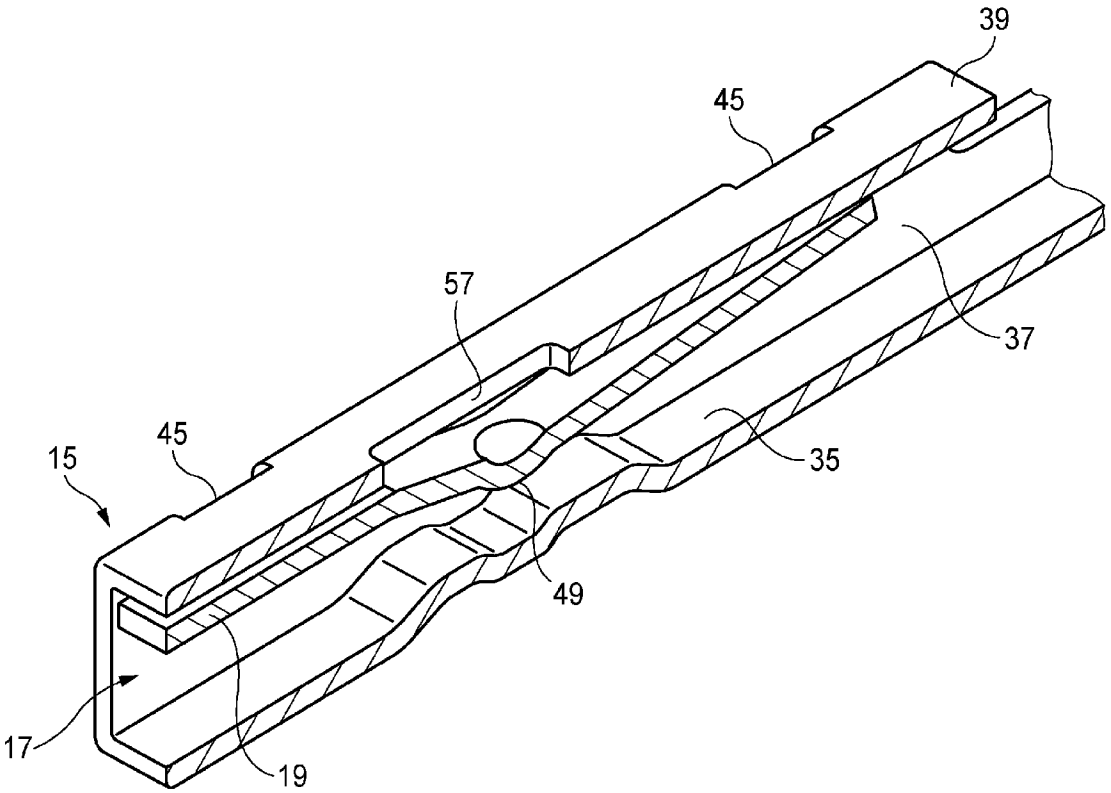
FIG. 3 is a partially cutaway enlarged perspective view of a terminal contact portion of FIG. 1.

The elastic piece 19 is bent into a curved shape of a reverse U-shape at its free end disposed backward of the terminal for causing an elastic urging force (see FIG. 3). Next, as illustrated with arrows in FIG. 2, the elastic piece 19 is bent to be overlaid on the top plate 39 with a gap provided therebetween. At this point, the pair of engaging projections 43 provided in the elastic piece 19 are positioned against the pair of engaging holes 45 formed in the first side plate 37. When the elastic piece 19 is bent into the curved shape, the pitch of the pair of engaging projections 43 accords with that of the pair of engaging holes 45.

Next, the top plate 39 is bent together with the elastic piece 19 against the first side plate 37. Simultaneously, the engaging projections 43 provided on the elastic piece 19 are inserted into the engaging holes of the first side plate 37 to be engaged with the engaging holes 45. Then, the first side plate 37 is bent vertically to the bottom plate 35. Next, after the second side plate 41 is bent vertically to the bottom plate 35, the shape holding portion 59 is bent against the second side plate 41 so as to overlay the shape holding portion 59 above the top plate 39, and thus, the production is completed.

Next, the operation of the female terminal 11 having the aforementioned constitution will be described.

In the female terminal 11 of the present embodiment, as illustrated in FIG. 4A, if a force in a direction moving away from the top plate 39 is applied to the elastic piece 19 and the elastic piece 19 is to move away from the top plate 39 by a prescribed or larger distance, this movement of the elastic piece 19 is restricted because the engaging projections 43 provided to project on the bent edge portion 51 hit against the engaging holes 45. Thus, the position of the elastic piece 19 is restricted by the pair of engaging projections 43 provided at the both ends along the terminal lengthwise direction, and is prevented from making an excessive displacement (uncontrollable movement) with which a normal contact load cannot be obtained. As a result, the elastic piece 19 is definitely positioned in a normal place to prevent the uncontrollable movement within the terminal contact portion 15 in the bending process or in inserting the male terminal 13, and hence, a stable contact load can be surely obtained.

Besides, if the clearances C are respectively provided between the elastic piece 19 and the first side plate 37 and the second side plate 41 as in the female terminal 11 of the above-described embodiment, the elastic piece 19 can be smoothly displaced without interfering with the first side plate 37 or the second side plate 41 when the elastic piece 19 is moved due to the insertion of the male terminal 13. Therefore, insertion resistance of the male terminal 13 can be prevented from increasing through, for example, sliding contact of the elastic piece 19 with the first side plate 37 or the second side plate 41. Furthermore, in the bending process of the female terminal 11 or in inserting a male terminal, if the elastic piece 19 is to be displaced in a direction for removing the engaging projections 43 from the engaging holes 45, since the clearance C provided between the second side plate 41 and the elastic piece 19 is smaller than the insertion length S of the engaging projections 43 inserted into the engaging holes 45, the elastic piece 19 hits against the second side plate 41, and hence the engaging projections 43 can be prevented from coming off from the engaging holes 45, and thus, reliability in obtaining a stable contact load can be improved.

Besides, in the female terminal 11 of the present embodiment, since the elastic piece 19 is continuously formed via the elastic piece bent portion 47 on the side of the top plate 39 so that the elastic piece 19 is wound (bent) from the side of the top plate 39, the female terminal can be laid out in the metal plate 21 in a smaller area as compared with the case where the elastic piece 19 is wound from the front side of the top plat 39. Accordingly, a larger number of products can be obtained from a given amount of used material, and the yield can be thus improved and the cost can be reduced.

Incidentally, in the female terminal 11 of the aforementioned embodiment, since all the portions are bent in the same direction in assembling the elastic piece 19 and forming the terminal contact portion 15, the production process is simple and the female terminal 11 can be easily formed. Besides, a processing tool used for executing a pressing operation or the like can be moved merely in one direction, and hence, the constitution of a production machine can be simplified.

Accordingly, in the female terminal 11 of the present embodiment, the uncontrollable movement of the elastic piece 19 within the terminal contact portion 15 can be prevented in the bending process or in inserting the male terminal 13, and a stable contact load can be surely obtained.

The characteristics of the female terminal according to the embodiment of the present invention will be simply summarized as the following [1] and [2]:

[1] A female terminal 11 includes a cylindrical tubular terminal contact portion 15 for receiving a male terminal 13 including: a bottom plate 35; a first side plate 37 and a second side plate 41 that respectively rise from both ends of the bottom plate 35 in a terminal widthwise direction; a top plate 39 that is bend and continuous from the first side plate 37; an elastic piece 19 in which an end portion of the top plate 39 in a terminal lengthwise direction as an elastic piece bent portion 47 is bent to be overlaid on the top plate 39;

a pair of engaging projections 43 that is provided to project at both end sides of the elastic piece 19 in the terminal lengthwise direction at a bent edge portion 51 of the elastic piece 19 in the terminal widthwise direction; and a pair of engaging holes 45 that is formed in the first side plate 37 correspondingly to the pair of engaging projections 43, and wherein the engaging projections 43 are respectively engaged with the engaging holes 45.

[2] The female terminal 11 according to [1] above, in which a clearance C smaller than an insertion length of the engaging projections 43 inserted into the engaging holes 45 is provided at least between the second side plate 41 and the elastic piece 19.

It is noted that the present invention is not limited to the above-described embodiment, but modifications, improvements and the like can be appropriately made. In addition, the materials, the shapes, the dimensions, the numbers, the positions and the like of the respective constituting elements of the above-described embodiment are arbitrary and not restrictive as long as the present invention can be accomplished.

This application is based upon the prior Japanese Patent Application (Japanese Patent Application No. 2012-265394) filed on Dec. 4, 2012, the entire contents of which are incorporated herein by reference.

INDUSTRIAL APPLICABILITY

According to the female terminal of the present invention, the uncontrollable movement of an elastic piece within a terminal contact portion can be prevented to surely obtain a stable contact load.

REFERENCE SIGNS LIST

11 . . . female terminal
13 . . . male terminal
15 . . . terminal contact portion
19 . . . elastic piece
35 . . . bottom plate
37 . . . first side plate
39 . . . top plate
41 . . . second side plate
43 . . . engaging projection
45 . . . engaging hole
47 . . . elastic piece bent portion
51 . . . bent edge portion
C . . . clearance
S . . . insertion length

The invention claimed is:

1. A female terminal comprising a tubular terminal contact portion configured for receiving a male terminal, the tubular terminal contact portion including:

a bottom plate;

a first side plate and a second side plate that respectively rise from both ends of the bottom plate in a terminal widthwise direction;

a top plate extending from the first side plate along a first bend;

an elastic piece overlaid on the top plate;

an elastic piece bent portion extending from the top plate to the elastic piece along a second bend, and the elastic piece bent portion provided at an end portion of the top plate in a terminal lengthwise direction;

a pair of engaging projections that project in the terminal widthwise direction from an edge portion of the elastic piece at locations separated from each other in the terminal lengthwise direction; and a pair of engaging holes provided in the first side and extending to the top plate through the first bend, and wherein the engaging projections are respectively engaged with the engaging holes.

2. The female terminal according to claim 1, wherein a clearance smaller than an insertion length of the engaging projections inserted into the engaging holes is provided at least between the second side plate and the elastic piece.

3. The female terminal according to claim 2, wherein each of the clearance and the insertion length are measured in the terminal widthwise direction, and the terminal widthwise direction is substantially perpendicular to the terminal lengthwise direction.

4. The female terminal according to claim 1, wherein a portion of the elastic piece between the pair of engaging projections in the terminal lengthwise direction is bent toward the bottom plate.

5. The female terminal according to claim 4, wherein the elastic piece includes an indent portion located at the portion of the elastic piece between the pair of engaging projections, and wherein the indent portion bulges toward the bottom plate.

6. The female terminal according to claim 1, wherein the second side plate terminates at a free edge that extends in the terminal lengthwise direction, and wherein the elastic piece bent portion abutting the free edge of the second side plate.

7. The female terminal according to claim 1, wherein the tubular terminal contact portion further including a shape holding portion continuous with the second side plate, and bends onto the top plate.

8. The female terminal according to claim 1, wherein the tubular terminal contact portion has an opening at one end configured for receiving the male terminal, and the tubular terminal contact portion extends from the opening in the terminal lengthwise direction to a second end.

9. The female terminal according to claim 8, wherein the tubular terminal contact portion further including:

a front pressing piece portion continuous with the second side plate, adjacent to the one end of the tubular terminal contact portion, and bending onto the top plate;

a rear pressing piece portion continuous with the second side plate, adjacent to the second end of the tubular terminal contact portion, and bending onto the top plate; and a fixing piece portion continuous with the second side plate, located between the front pressing piece portion and the rear pressing piece portion, and bending onto the top plate.

10. The female terminal according to claim 8, wherein the elastic piece terminates at a free end that is adjacent the second end of the tubular terminal contact portion.

11. The female terminal according to claim 10, wherein one of the engaging projections is provided at the free end of the elastic piece.

12. The female terminal according to claim 8, further comprising a wire connection portion connected the second end of the tubular terminal contact portion and extending away from the tubular terminal contact portion in the terminal lengthwise direction.

13. The female terminal according to claim 1, wherein the second bend extends in the terminal lengthwise direction and not in the terminal widthwise direction.

* * * * *